US008690698B2

(12) United States Patent
Saito et al.

(10) Patent No.: US 8,690,698 B2
(45) Date of Patent: Apr. 8, 2014

(54) GOLF SWING CLASSIFICATION METHOD, SYSTEM, DEVICE, AND PROGRAM

(75) Inventors: Takashi Saito, Yokohama (JP); Koji Takao, Hachioji (JP); Hideo Matsunaga, Tokorozawa (JP); Hirotada Iwade, Hannou-shu (JP)

(73) Assignees: Bridgestone Corporation, Tokyo (JP); Bridgestone Sports Co., Ltd, Tokyo (JP)

( * ) Notice: Subject to any disclaimer, the term of this patent is extended or adjusted under 35 U.S.C. 154(b) by 58 days.

(21) Appl. No.: 13/304,071

(22) Filed: Nov. 23, 2011

(65) Prior Publication Data

US 2012/0136464 A1 May 31, 2012

(30) Foreign Application Priority Data

Nov. 26, 2010 (JP) ..... 2010-264120

(51) Int. Cl.
*A63F 9/24* (2006.01)
*G06F 17/00* (2006.01)

(52) U.S. Cl.
USPC ..... 473/131; 473/222; 473/219; 473/257; 473/407; 434/252

(58) Field of Classification Search
None
See application file for complete search history.

(56) References Cited

U.S. PATENT DOCUMENTS 5,697,791 A * 12/1997 Nashner et al. ..... 434/247
6,095,928 A * 8/2000 Goszyk ..... 473/222
6,514,081 B1 * 2/2003 Mengoli ..... 434/252
2004/0092326 A1 * 5/2004 Cameron et al. ..... 473/219
2005/0213076 A1 * 9/2005 Saegusa ..... 356/28
2005/0215336 A1 * 9/2005 Ueda et al. ..... 473/131
2006/0211510 A1 * 9/2006 Ashida et al. ..... 473/316
2007/0135225 A1 * 6/2007 Nieminen et al. ..... 473/212
2008/0261712 A1 * 10/2008 Quirk ..... 473/257
2012/0238380 A9 * 9/2012 Marty et al. ..... 473/407

FOREIGN PATENT DOCUMENTS

JP H06-210027 A 8/1994
JP 2010-046539 A 3/2010

OTHER PUBLICATIONS

Chinese Office Action issued in Chinese Application No. 201110396167.0 dated Jan. 2, 2014.
Japanese Office Action issued in Japanese Application No. 2010-264120 dated Oct. 1, 2013.

* cited by examiner

*Primary Examiner* — Paul A D'Agostino
(74) *Attorney, Agent, or Firm* — Sughrue Mion, PLLC

(57) ABSTRACT

An object of the present invention is to provide a golf club classification method capable of classifying a golf swing precisely. Specifically, the present invention provides a classification method comprising steps of: partitioning the golf swing of the golfer into golf swing trajectories of a back swing, a down swing, and a follow through so as to determine a stable point in the golf swing trajectories as an origin for any two of the trajectories and to assign a two dimensional coordinate to the two golf swing trajectories; determining straight lines connecting each of one point selected within each of the two golf swing trajectories and the origin; calculating angles between each of the determined straight lines and the horizontal line respectively for the two golf swing trajectories; and classifying the golf swing based on a difference between the calculated angles.

8 Claims, 7 Drawing Sheets

GOLF SWING CLASSIFICATION METHOD, SYSTEM, DEVICE, AND PROGRAM

BACKGROUND OF THE INVENTION

1. Field of the Invention

The present invention relates to a golf club classification method, system, device and program.

2. Description of Related Art

Generally, when a golfer swings a golf club with an intention for hitting (shooting) a golf ball straight forward, it is desirable that a flying direction of the golf ball is relatively straight and not (hardly) curved. Such desirable shot is realized relatively easily in the case where every golfer uses an appropriate golf club. However, as a practical matter, it is not easy for a golfer to select an appropriate golf club that is suitable for oneself at a shop.

Therefore, as disclosed in JP 6210027 (A), for example, a design method for a golf club capable of estimating the optimal club property and shape suitable for a swing of an individual golfer has been developed. According to the design method in JP 6210027 (A), design parameters for golf club, such as torsional stiffness of a shaft, inertia moment of a head, barycentric position, shape (e.g. loft angle, lie angle) and static characteristics are related to head speed, shooting out angle of a golf ball ("ball" in the following), amount of spinning, easiness of shooting, and therefore, these parameters play important roles in determination of flying distance and direction. The static characteristics are a length of golf shaft ("shaft" in the following), a balance, a weight of a club, and a hardness of the shaft.

Also, as disclosed in JP 2010046539 (A), a method for golf club selection has been suggested. The method in JP 2010046539 (A) includes the steps of: obtaining, during a golf swing, information of a vertical movement direction of a golf club head relative to a horizontal plane immediately before striking a golf ball, and information of a horizontal movement direction of the golf club head immediately before striking the golf ball (impact) on a plane parallel to the horizontal plane, classifying the golf swing into any one of predetermined types using the information obtained, and selecting a golf club suitable for the classified type.

SUMMARY OF THE INVENTION

Problems to be solved by the Invention

However, even in the case where a design method utilizing the plurality of parameters disclosed in JP 6210027 (A) is established for estimating the optimal club property and shape suitable for a swing of an individual golfer, designing custom golf club requires long time. Accordingly, a golfer can not select and determine a suitable golf club in a shop.

Therefore, as a method for classifying golf swing type in a relatively easy manner, the classification method disclosed in JP 2010046539 (A) can be used. However, the method executes a classification based on the information of golf club head direction and the like immediately before the impact, and other information related to a swing before reaching around an impact position does not contribute to the classification. Therefore, the precision of classification was still open for improvement.

The object of the present invention is to provide a golf club classification method, system, device and program capable of classifying golf swing precisely.

Means for Solving the Problems

In order to achieve the aforementioned purpose, the classification method according to the present invention is a classification method for classifying a golf swing conducted by a golfer when the golfer hits a golf ball by a golf club; the method including steps of:

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

determining straight lines connecting each of one point selected within each of the two golf swing trajectories and the origin;

calculating angles between each of the determined straight lines and the horizontal line respectively for the two golf swing trajectories; and classifying the golf swing based on a difference between the calculated angles.

The classification method according to the present invention is a classification method for classifying a golf swing conducted by a golfer when the golfer hits a golf ball by a golf club; the method including steps of:

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

calculating maximum distances along a direction of the horizontal axis from the origin respectively for the two golf swing trajectories; and classifying the golf swing based on a difference between the calculated maximum distances.

The classification method according to the present invention is a classification method for classifying a golf swing conducted by a golfer when the golfer hits a golf ball by a golf club; the method including steps of:

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a first trajectory distribution;

determining straight lines connecting each of one point selected within each of the two golf swing trajectories and the origin so as to calculate angles between each of the determined straight lines and the horizontal line respectively for the two golf swing trajectories;

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a second trajectory distribution;

calculating maximum distances along a direction of the horizontal axis from the origin respectively for the two golf swing trajectories; and classifying the golf swing based on a difference between the calculated angles and a difference between the calculated maximum distances.

In order to achieve the aforementioned purpose, a classification system according to the present invention is a classification system for classifying a golf swing conducted by a golfer when the golfer hits a golf ball by a golf club; the system including:

an imaging camera for imaging the golf swing by the golfer and a analysis device for analyzing the imaged golf swing; the analysis device including;

a measurement unit for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

a characteristics extraction unit for determining straight lines connecting each of one point selected within each of the two golf swing trajectories and the origin so a to calculate angles between each of the determined straight lines and the horizontal line respectively for the two golf swing trajectories; and a statistical processing unit for classifying the golf swing based on a difference between the calculated angles.

The classification system according to the present invention is a classification system for classifying a golf swing conducted by a golfer when the golfer hits a golf ball by a golf club; the system including:

an imaging camera for imaging the golf swing by the golfer and a analysis device for analyzing the imaged golf swing; the analysis device including;

a measurement unit for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

a characteristics extraction unit for calculating maximum distances along a direction of the horizontal axis from the origin respectively for the two golf swing trajectories; and a statistical processing unit for classifying the golf swing based on a difference between the calculated maximum distances.

The classification system according to the present invention is a classification system for classifying a golf swing conducted by a golfer when the golfer hits a golf ball by a golf club; the system including:

an imaging camera for imaging the golf swing by the golfer and a analysis device for analyzing the imaged golf swing; the analysis device including;

a measurement unit for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a first trajectory distribution and for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a second trajectory distribution;

a characteristics extraction unit for determining straight lines connecting each of one point selected within each of the two golf swing trajectories and the origin so a to calculate angles between each of the determined straight lines and the horizontal line respectively for the first trajectory distribution and for calculating maximum distances along a direction of the horizontal axis from the origin respectively for the second trajectory distribution;

a statistical processing unit for classifying the golf swing based on a difference between the calculated angles and a difference between the calculated maximum distances.

In order to achieve the aforementioned purpose, a classification device according to the present invention is a classification device for classifying a golf swing conducted by a golfer when the golfer hits a golf ball by a golf club; the device including:

a measurement unit for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

a characteristics extraction unit for determining straight lines connecting each of one point selected within each of the two golf swing trajectories and the origin so a to calculate angles between each of the determined straight lines and the horizontal line respectively for the two golf swing trajectories; and a statistical processing unit for classifying the golf swing based on a difference between the calculated angles.

The classification device according to the present invention is a classification device for classifying a golf swing conducted by a golfer when the golfer hits a golf ball by a golf club; the device including:

a measurement unit for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

a characteristics extraction unit for calculating maximum distances along a direction of the horizontal axis from the origin respectively for the two golf swing trajectories; and a statistical processing unit for classifying the golf swing based on a difference between the calculated maximum distances.

The classification device according to the present invention is a classification device for classifying a golf swing conducted by a golfer when the golfer hits a golf ball by a golf club; the device including:

a measurement unit for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a first trajectory distribution and for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a second trajectory distribution;

a characteristics extraction unit for determining straight lines connecting each of one point selected within each of the two golf swing trajectories and the origin so a to calculate angles between each of the determined straight lines and the horizontal line respectively for the first trajectory distribution and for calculating maximum distances along a direction of the horizontal axis from the origin respectively for the second trajectory distribution;

a statistical processing unit for classifying the golf swing based on a difference between the calculated angles and a difference between the calculated maximum distances.

In order to achieve the aforementioned purpose, a program according to the present invention is a program for executing the following steps by a computer functioning as an analysis device for analyzing a golf swing conducted by a golfer when the golfer hits a golf ball by a golf club; the program including the steps of:

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

determining straight lines connecting each of one point selected within each of the two golf swing trajectories and the origin;

calculating angles between each of the determined straight lines and the horizontal line respectively for the two golf swing trajectories; and classifying the golf swing based on a difference between the calculated angles.

The program according to the present invention is a program for executing the following steps by a computer functioning as an analysis device for analyzing a golf swing conducted by a golfer when the golfer hits a golf ball by a golf club; the program including the steps of:

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

calculating maximum distances along a direction of the horizontal axis from the origin respectively for the two golf swing trajectories; and classifying the golf swing based on a difference between the calculated maximum distances.

The program according to the present invention is a program for executing the following steps by a computer functioning as an analysis device for analyzing a golf swing conducted by a golfer when the golfer hits a golf ball by a golf club; the program including the steps of:

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a first trajectory distribution;

determining straight lines connecting each of one point selected within each of the two golf swing trajectories and the origin so as to calculate angles between each of the determined straight lines and the horizontal line respectively for the two golf swing trajectories;

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a second trajectory distribution;

calculating maximum distances along a direction of the horizontal axis from the origin respectively for the two golf swing trajectories; and classifying the golf swing based on a difference between the calculated angles and a difference between the calculated maximum distances.

Effect of the Invention

According to the present invention, in classifying a golf swing conducted by a golfer based on a golf swing trajectory when the golfer hits a golf ball by a golf club, it is possible to acquire a golf swing trajectory, to apply a coordinate to the golf swing trajectory, to calculate angles between each of two predetermined points on the golf swing trajectory and the horizontal line of the coordinate, and to classify the golf swing trajectory based on a difference between the calculated angles. Therefore, classification is done not only based on characteristics immediately before the impact position but on characteristics of broader range of golf swing. Accordingly, precise classification result that is not affected by a difference of height of the golfers is provided by utilizing the difference between the calculated angles.

Moreover, according to the golf swing trajectory classification method of the present invention, in classifying a golf swing conducted by a golfer based on a golf swing trajectory when the golfer hits a golf ball by a golf club, it is possible to acquire a golf swing trajectory, to apply a coordinate to the golf swing trajectory, to calculate distance between two predetermined points on the golf swing trajectory, and to classify the golf swing trajectory based on the calculated distance. Therefore, classification is done not only based on characteristics immediately before the impact position but on characteristics of broader range of golf swing. Accordingly, precise classification result that is not affected by a difference of height of the golfers is provided by utilizing the difference between the calculated distances.

Moreover, according to the golf swing trajectory classification method of the present invention, in classifying a golf swing conducted by a golfer based on a golf swing trajectory when the golfer hits a golf ball by a golf club, it is possible to acquire a golf swing trajectory, to apply a coordinate to the golf swing trajectory, to calculate angles between each of two predetermined points on the golf swing trajectory and the horizontal line of the coordinate and distance between two predetermined points on the golf swing trajectory, and to classify the golf swing trajectory based on a difference between the calculated angles and the calculated distance. Therefore, detailed classification is available.

DESCRIPTION OF A PREFERRED EMBODIMENT

The golf swing classification system according to an embodiment of the present invention will be set forth below with reference to drawings. The classification method, system, analysis device and program are also revealed by the description for the golf swing classification system according to the embodiment of the present invention.

Figure 1:
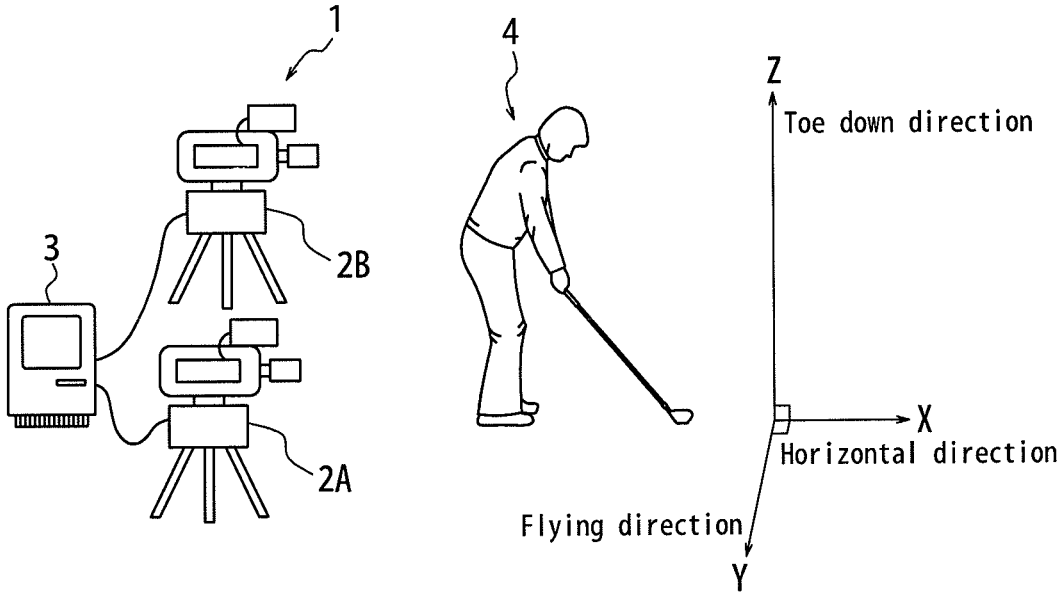
FIG. 1 is a schematic illustration illustrating a golf swing classification system according to an embodiment of the present invention.

FIG. 1 is a schematic illustration illustrating a golf swing classification system according to an embodiment of the present invention. The classification system 1 shown in FIG. 1 includes imaging cameras (the first camera 2A and the second camera 2B) for imaging the golf swing by the golfer when the golfer hits a golf ball by a golf club and an analysis devices 3 that analyses a golf swing trajectory from the acquired image.

The first camera 2A and the second camera 2B image a golf swing conducted by an examinee (a golfer) 4. The first camera 2A and the second camera 2B are spaced apart each other by a predetermined distance so as to acquire images (videos) used for three dimensional measurement of a golf swing trajectory. Preferably, the distance between the first camera 2A and the second camera 2B are fixed so as to facilitate the three dimensional measurement for the golf swing trajectory by simplifying a calculation of a relative location between the first camera 2A and the second camera 2B after acquiring the images of golf swing by the first camera 2A and the second camera 2B.

The first camera 2A and the second camera 2B image a golf swing conducted by an examinee (a golfer) 4. The first camera 2A and the second camera 2B are spaced apart each other by a predetermined distance so as to acquire images (videos) used for three dimensional measurement of a golf swing trajectory. Preferably, the distance between the first camera 2A and the second camera 2B are fixed so as to facilitate the three dimensional measurement for the golf swing trajectory by simplifying a calculation of a relative location between the first camera 2A and the second camera 2B after acquiring the images of golf swing by the first camera 2A and the second camera 2B.

Also, the first camera 2A and the second camera 2B are spaced apart so as to image the golf club used by the examinee 4 in each stage of the golf swing, such as back swing, down swing, or follow through, described below in greater detail with reference to FIG. 3, for acquiring images of the golf swing conducted by the examinee 4. As mentioned above, preferably, the space between the first camera 2A and the second camera 2B is fixed. Thus, it is possible to compare the measured swing trajectories in an identical plane even if the distance of the camera 2A and the second camera 2B from the examinee 4 is adjusted arbitrarily according to the height and the physical size of the examinee. A parallax between the first camera 2A and the second camera 2B is constant, since the distance therebetween is fixed. Accordingly, a camera coordinate can easily be converted into the world coordinate.

In FIG. 1, the center of the golf ball ("golf ball position" in the followings) to be hit by the examinee 4 is determined as an origin. An axis through the origin, that is perpendicular to the horizontal line along with toe down direction, is called as the z axis. Here, the toe down direction corresponds to a plumb direction. Moreover, an axis through the origin, perpendicular to a line connecting both shoulders of the examinee 4, and in the horizontal plane, is call as the X axis. Further, an axis through the origin, perpendicular to the X axis and the Z axis, is called as the Y axis. The Y axis direction is substantially corresponding to the flying direction of the golf ball, and the Y axis is called as the "flying direction".

Figure 2:
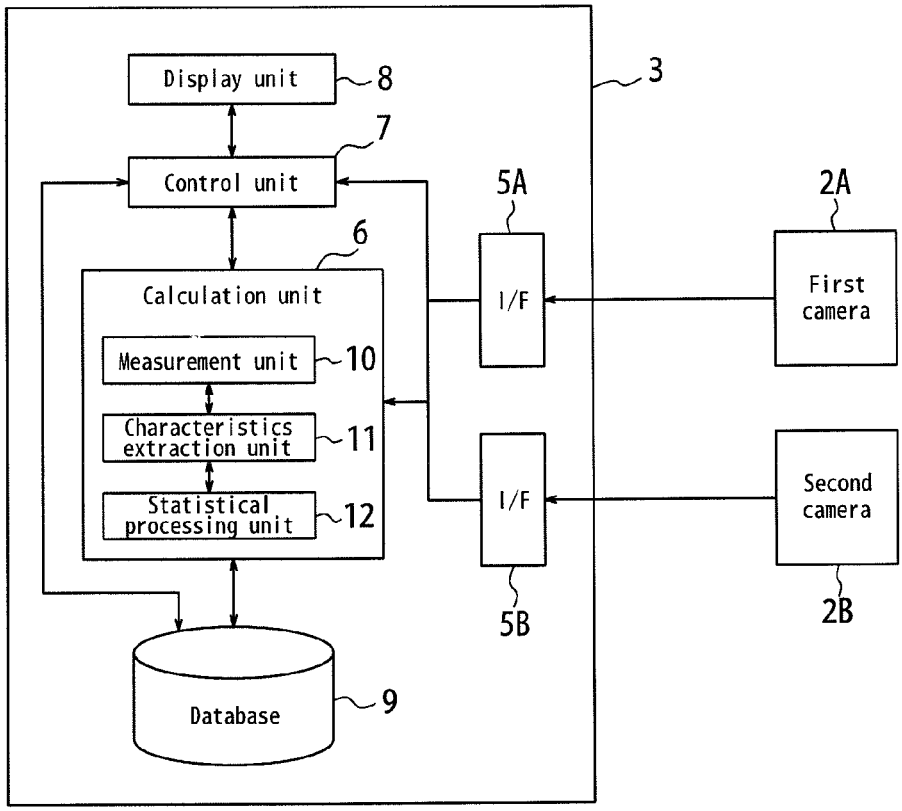
FIG. 2 is a functional block diagram illustrating schematic structure of an analysis device of the system in FIG. 1.

FIG. 2 shows a functional block diagram illustrating schematic structure of an analysis device 3. The analysis device 3 acquires golf swing images from the first camera 2A and the second camera 2B via the interfaces (I/F) 5A and 5B. The analysis device is equipped with a calculation unit 6 for executing calculation, a control unit 7 for overall controlling of the analysis device 3, a display unit 8 for displaying images from the first camera 2A and the second camera 2B, and a database 9 for storing the calculation result from the calculation unit 6. The calculation unit 6 further has a measurement unit 10, a characteristics extraction unit 11, and a statistical processing unit 12.

The measurement unit 10 has functionalities of partitioning the golf swing of the golfer, imaged from a lateral side and/or a front side or a back side, into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a first trajectory distribution; and of partitioning the golf swing of the golfer, imaged from the front side or the back side, into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a second trajectory distribution.

More specifically, the measurement unit 10 partitions the golf swing trajectory in a XZ plane (see FIG. 1) for acquiring a difference between angles. Also, the measurement unit 10 partitions the golf swing trajectory in a YZ plane (see FIG. 1) for acquiring a difference distances.

The characteristics extraction unit 11 has functionalities of determining straight lines connecting each of one point selected within each of the two golf swing trajectories and the origin so as to calculate angles between each of the determined straight lines and the horizontal line respectively for the two golf swing trajectories; and of calculating maximum distances along a direction of the horizontal axis from the origin respectively for the two golf swing trajectories.

More specifically, the characteristics extraction unit 11 calculates characteristics of feature values of the golf swing, based on the measurement result from the measurement unit 10. The feature values are a difference between the angles and a difference between the distances. The difference between the angles means a value calculated in the following steps: determining straight lines connecting each of one point selected within each of the two golf swing trajectories (in this example, these are golf swing trajectories of down swing and follow swing) and the origin; calculating angles between each of the determined straight lines and the horizontal line (the X axis in FIG. 1) for the two golf swing trajectories; and calculating the difference between the angles. The difference between the distances means a value calculated in the following steps: calculating maximum distances along a direction of the horizontal axis from the origin for the two golf swing trajectories (in this example, these are golf swing trajectories of back swing and down swing); and calculating the difference between the distances.

The statistical processing unit 12 has functionalities of classifying the golf swing based on the difference in the maximum distances calculated by the characteristics extraction unit 11; generating a two dimensional map by using the difference between the maximum distances and the difference in the angles calculated by the characteristics extraction unit 11; and classifying the golf swing based on the two dimensional map.

Figure 3:
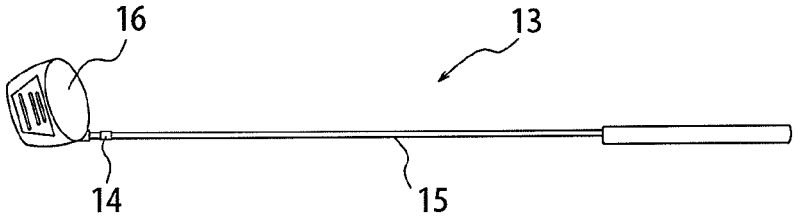
FIG. 3 is an example of golf club used in the system in FIG. 1.

FIG. 3 shows an example of golf club used in the golf swing classification system according to one embodiment of the present invention. The examinee 4 conducts a golf swing by using the golf club 13 (called as "golf club for measurements" in below). The first camera 2A and the second camera 2B acquire images of the golf swing. The golf club 13 for measurements has a tracking marker 4 on shaft 15 near the golf club head 16 that is a portion to be used for hitting a golf ball. This marker consists of a white reflective tape, a spherical marker, a reflective marker and the like, for example. Accordingly, the trajectory of the marker 14 can be tracked easily by image processing on images of the golf swing captured in a black back ground. Also, periods of time during which the marker 14 is hid behind the examinee 4 can be reduced by attaching the marker 14 near the golf club head, even if the first camera 2A and the second camera 2B were arranged behind the examinee 4.

Figure 4A:
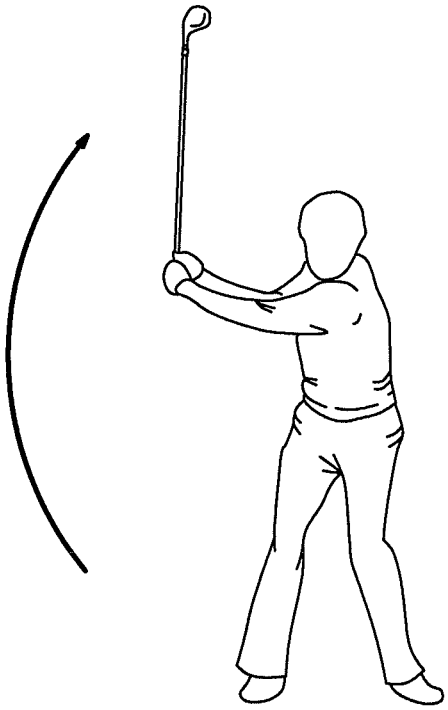
FIG. 4A is a diagram illustrating a golf swing.
Figure 4B:
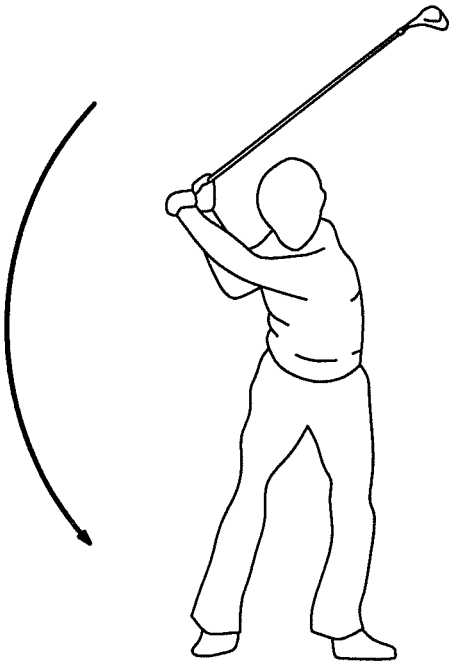
FIG. 4B is a diagram illustrating a golf swing.
Figure 4C:
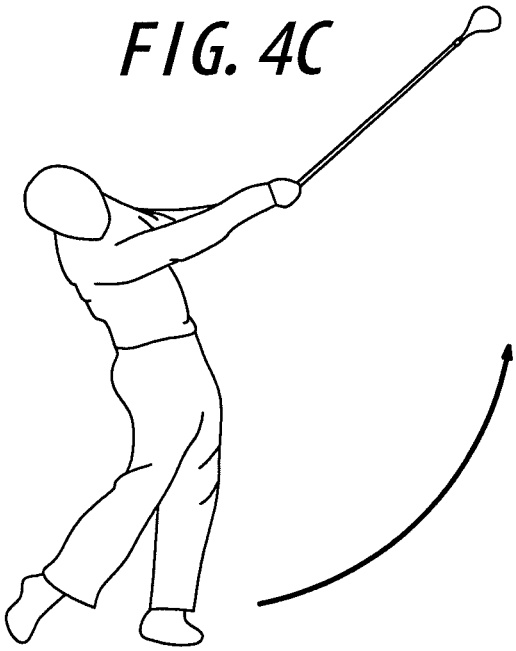
FIG. 4C is a diagram illustrating a golf swing.

FIG. 4 is a diagram illustrating a golf swing. Here, the golf swing is partitioned into three stages, which are back swing, down swing, and follow through. The FIG. 4A shows a back swing, in which the examinee 4 swings the golf club for measurements backward. FIG. 4B shows a down swing, in which the examinee 4 swings down the golf club for measurements swung up in the back swing stage (FIG. 4A) for hitting a golf ball. FIG. 4C shows a follow through, in which the examinee 4 swings through the golf club for measurements. Subsequently, a finish stage representing the completion of the golf swing follows up after the follow through.

Figure 5:
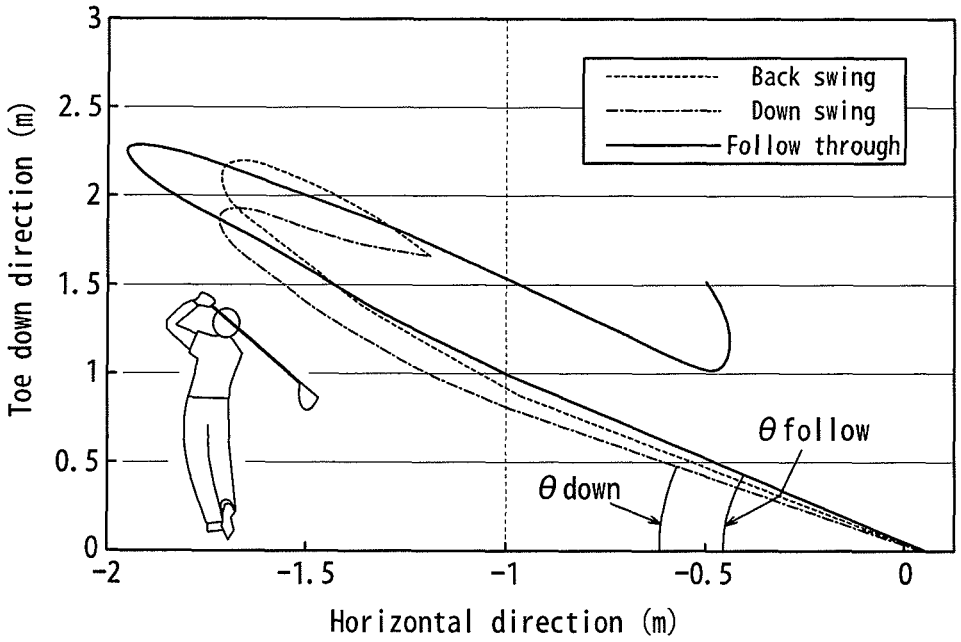
FIG. 5 is a graph showing an example of measurement result using the system in FIG. 1.

FIG. 5 is a graph showing an example of measurement result using the system in FIG. 1. A dashed line shows a trajectory of a back swing; a dashed-dotted line shows a trajectory of a down swing; and a solid line shows a trajectory of a follow through. The vertical axis corresponds to the Z axis in FIG. 1, and represents the position (meters) along a height (toe down) direction under a condition where the center of the golf ball (corresponding to the origin in FIG. 1, called as "impact position" in below) is set as position of zero meters. The horizontal axis corresponds to the X axis in FIG. 1, and represents a distance from an impact position under a condition where the impact position is set as zero meters and the distance spaced forward of the examinee is shown by a positive value and the distance spaced backward of the examinee is shown by a negative value. Positions of the marker during the golf swing using the golf club for measurements shown in FIG. 2 conducted by the examinee are plotted on this plane and a trajectory distribution is prepared. As shown in FIG. 3, the horizontal axis does not accompany positive values, since the marker is attached to a portion of the shaft near the head of the golf club for measurements.

In the followings, a method for extracting characteristics used as indices for classifying a golf swing trajectory executed in the characteristics extraction unit 11 of the analysis device 3 is described. The inventors have found that a difference between angles between straight lines connecting the impact position and a point on each of the golf swing trajectories of follow swing and of down swing and the horizontal axis (the X axis) is works as an effective index to be used for classification. The effects of variation of height of the examinees can be cancelled by utilizing the difference between angles for the golf swing classification rather than by utilizing the spatial position on the golf swing trajectory. The angles defined by each of straight lines connecting each of the points on the golf swing trajectory and the origin and the horizontal axis (the X axis). Then, the difference in angles is used as an index for the classification.

In the calculation of the index, firstly, impact point as a standard and a arbitral point on the follow swing trajectory (for example, the marker position projected to approximately −1 meter along the horizontal direction (approximate X axis direction) are connected by a straight line and its angle between a ground plane is calculated and determined as "θ follow". Similar calculation is conducted for down swing and the calculated angle is defined as "θ down". In the case where the θ follow is larger than θ down, the golf ball tends to rotate right-to-left. As a result of such rotation, the ball flies leftward with respect to the flying direction of the ball. On the other hand, in the case where the θ down is larger than θ follow, the ball tends to rotate left-to-right (outward). As a result of such rotation, the ball flies rightward with respect to the flying direction of the ball.

In this way, the relation between θ down and θ follow can provide important information for golfers. Moreover, one or more thresholds related to the difference between the values of θ down and θ follow can be determined for conducting a golf swing classification. Actually, by conducting a classification based on one characteristic such as the difference between the values of θ down and θ follow (called as "one-dimensional classification" in below), golf swings conducted by experienced players can be distinguished from those conducted by non-experienced players. Please note that the standard is not limited to the impact point, and any points other than the impact point (corresponding to the center of the golf ball) can be employed as an origin. In such case, above calculation is conducted by using the point other than the impact point as a standard.

Figure 6:
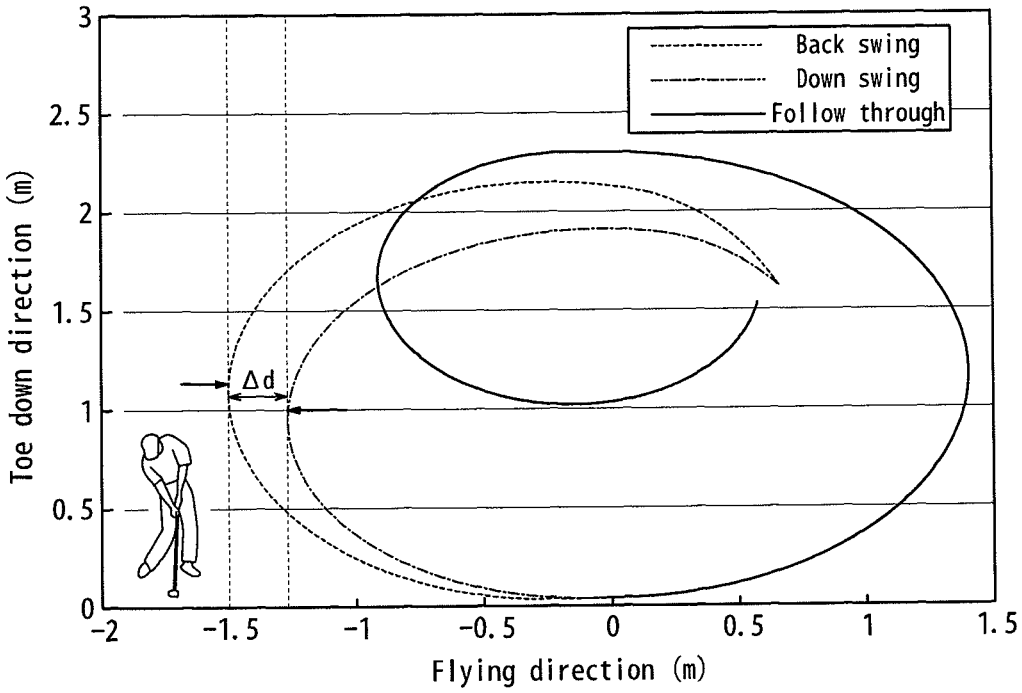
FIG. 6 is a graph showing an example of measurement result using the system in FIG. 1.

FIG. 6 is a graph showing an example of measurement result using the system in FIG. 1. As shown in FIG. 5, a dashed line shows a trajectory of a back swing; a dashed-dotted line shows a trajectory of a down swing; and a solid line shows a trajectory of a follow through. Similar to FIG. 5, the vertical axis represents the position along a toe down direction and the horizontal axis corresponds to the Y axis in FIG. 1, corresponding to the flying direction of the golf ball. In the horizontal axis, a distance from an impact position is shown under the condition where the impact position is set as zero meters and distance on the right of the examinee is shown by a positive value and the distance on the left of the examinee is shown by a negative value. When hits the golf ball, the golfer swings up the golf club 13 for measurements backward, hits the golf ball at the impact position as a result of the down swing, and leads to the finish stage via the follow through. FIG. 6 shows a trajectory distribution for the marker 14 attached to the golf club 13 for measurements viewed from the X axis direction in FIG. 1.

In the followings, a method for extracting characteristics used as indices for classifying a golf swing trajectory executed in the characteristics extraction unit 11 of the analysis device 3 is described. The inventors have found that a difference (Δd) in maximum distances from the impact position for golf swing trajectories of back swing and down swing can be an effective index for golf swing classification. The maximum distance is a distance along with the flying direction (the Y axis). For example, arrows denote the positions where respective trajectories of back swing and down swing along the flying direction (the Y axis) are maximally apart from each other. In calculating the difference in distances (Δd), the characteristics calculation unit 11 calculates the distance between the positions projected on the Y axis. In the case where the difference in distances (Δd) is larger and the trajectory of the down swing lies on inner side by a wide margin, head speed is relatively rapid.

Accordingly, the effects of variation of height of the examinees can be cancelled by utilizing the difference in distance (Δd) for the golf swing classification. Moreover, by conducting the one-dimensional classification based on the value of the difference in distance (Δd), golf swings conducted by experienced players can be distinguished from those conducted by non-experienced players. Specifically, one or more thresholds related to the difference in distance can be determined for conducting a golf swing classification.

Figure 7:
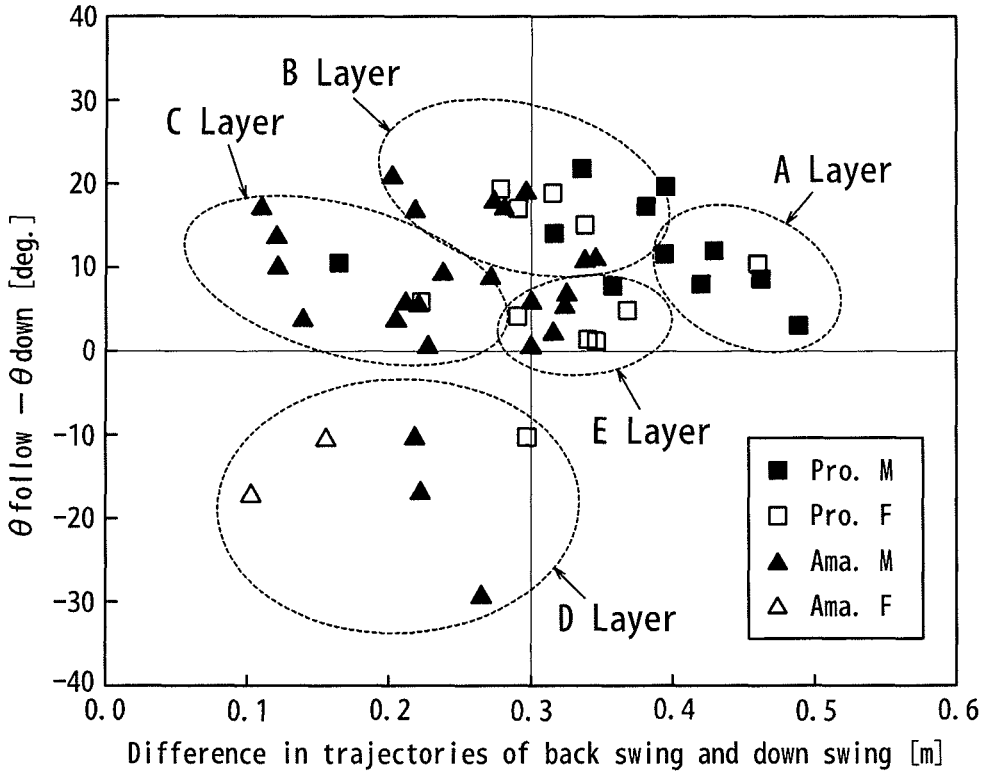
FIG. 7 is a graph showing an example of measurement result using the system in FIG. 1.

FIG. 7 is a graph showing an example of measurement result using the system in FIG. 1. The difference between θ follow and θ down ("θ follow−θ down", shown as "Δθ", in below) which is a characteristic described with reference to FIG. 5 is shown in the vertical axis. Also, the difference in distance (Δd) between the trajectories of back swing and the down swing is shown in the horizontal axis. Here, golf swing trajectories are measured by using the system in FIG. 1 and the characteristics described with reference to FIG. 5 are extracted for a plurality of professional male golfers (Pro. M), of professional female golfers (Pro. F), of amateur male golfers (Ama. M), and of amateur female golfers (Ama. F). These data is stored in the database 9 of the analysis device 3. Subsequently, the statistical processing unit 12 of the analysis device 3 plots each characteristic to the two dimensional plane so as to generate a two dimensional map having a vertical and horizontal axes showing either of the above mentioned two characteristics. Then, the statistical processing unit 12 executes clustering on the generated two dimensional map so as to extract classification classes of layers A to E.

In classifying golf swing, the analysis device 3 extracts characteristics described with reference to FIG. 5 and FIG. 6 from a golf swing to be measured and classifies the golf swing into either of above mentioned layers A to E by using, for example, minimum distance classification method. In this way, the statistical processing unit 12 classifies the golf swing type into layers based on the characteristics extracted from the trajectory of the golf swing.

Figure 8:
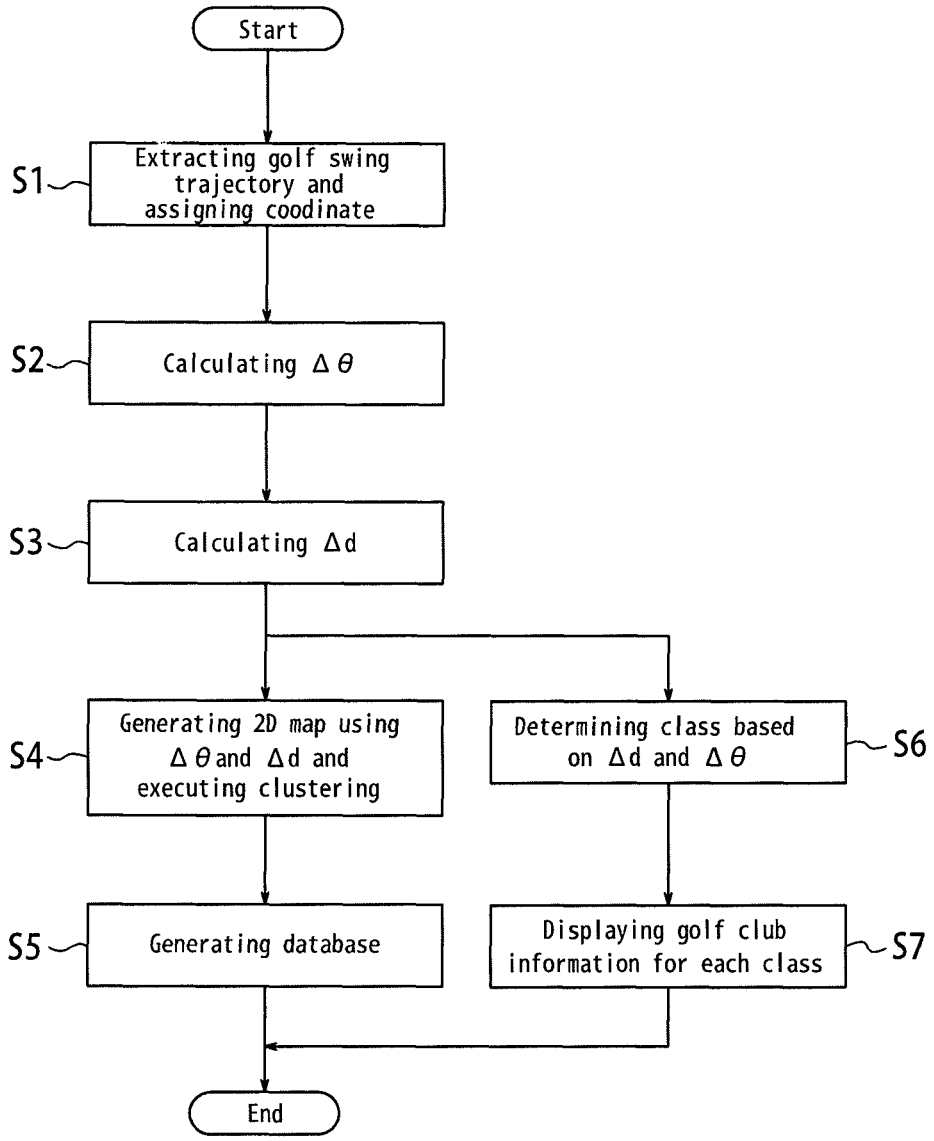
FIG. 8 is a flow chart illustrating a golf swing classification system according to an embodiment of the present invention.

FIG. 8 is a flow chart illustrating a golf swing classification system according to an embodiment of the present invention. The measurement unit 10 extracts information of a golf swing trajectory from data acquired from the first camera 2A and the second camera 2B and assigns a coordinate to the golf swing trajectory (S1). The characteristics extraction unit 11 calculates a value of Δθ, which is a difference between θ follow and θ down, by using the method described with reference to FIG. 5 (S2). Moreover, the characteristics extraction unit 11 calculates a value of Δd, which is a difference in distances, by using the method described with reference to FIG. 6 (S3). Here, the processing in Steps S1 to S3 is repeated for a plurality of data set (e.g. data set for a plurality of professional male and female golfers and amateur male and female golfers) and an arbitral number of data set is stored in the database 9.

The statistical processing unit 12 generates a two dimensional map by using Δθ and Δd based on a plurality of data set stored in the database 9 (S4). The statistical processing unit 12 stores the classification classes extracted by the clustering in the database 9 so as to generate a database (S5). Here, the database 9 preliminarily keeps information of golf clubs suitable for individuals belonging to either of the data sets (including a plurality of professional male and female golfers and amateur male and female golfers).

In this way, each functional units included in the calculation unit 6 executes calculation and stores the calculation result so as to generate a database. The flow for classifying a golf swing of one examinee (golfer) is described below.

First of all, each functional units included in the calculation unit 6 executes processing in steps S1 to S3 and extracts characteristics. Then, the statistical calculation unit 12 accesses the database 9 and determines a class to which the extracted characteristics (Δθ and Δd) of the examinee's golf swing have a resemblance by using the minimum distance classification method (S6). Then, the control unit 7 preferably displays the information of golf club related to the plurality of professional male and female golfers and amateur male and female golfers corresponding to a class selected by the statistical processing unit 12 (S7).

According to the present embodiment of the invention, the difference in angles and/or the difference in distances is/are calculated for any two of partitioned golf swing trajectories of back swing, down swing, and follow through so as to generate a two dimensional map and classifies the golf swing based on the two dimensional map. Therefore, the golf swing trajectory can be classified in detail. Preferably, it is possible to provide an index for an examinee to select an optimal golf club by displaying a possible golf club suitable for the examinee, based on the classification result. Other than generating the two dimensional map, data set can be recorded in a table and classification can be executed based on the table.

Further, in one embodiment of the present invention, the analysis device can be realized as a computer. A program for operating such computer as the device can be recorded in a memory unit attached internally or externally to the computer. Such memory unit can be realized as an external memory device, or an internal memory device such as ROM (read only memory), and RAM (random access memory). A computer functions as the above mentioned device can be realized under control of a CPU (central processing unit) and the like. That is, the CPU arbitrarily reads a program including processing contents for realizing a function of each component from the memory unit and the CPU realizes a functionality of each component on the computer. Here, the functionality of each component may be realized by a part of hardware.

The program may be distributed by selling, transferring, or leasing a removable recording medium such as a DVD (Digital Versatile Disc) or a CD-ROM, for example, on which the program is recorded. Alternatively, the program may be distributed by storing it in a memory unit of a server computer beforehand and transmitting it from the server computer to another computer via a network.

For example, the computer executing such programs may also temporarily store the program recorded in a removable recording medium or transferred from a server computer into its memory unit. Alternatively, a computer may directly read the program from a removable recording medium and execute processing according to the program, or the computer may execute processing according to the program each time the program is transmitted from a server to the computer.

According to the present invention, a golf swing conducted by a golfer can be classified and a shaft and a club suitable for each golfer can be suggested based on the classification result.

One embodiment of the present invention has been described above. Various modifications can be adapted without departing from the scope of the claim. For example, the first camera 2A and the second camera 2B are used for acquiring stereo images so as to enhance the precision of the measurement, in the above mentioned embodiment. However, cameras can be arranged on back side and lateral side of the examinee 4 and the cameras can take images in a normal manner so as to acquire a golf swing trajectory based on a two dimensional measurement.

What is claimed is:

1. A classification method for classifying a golf swing conducted by a golfer when the golfer hits a golf ball by a golf club; the method comprising steps of:

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

calculating maximum distances along a direction of the horizontal axis from the origin respectively for the two golf swing trajectories; and classifying the golf swing based on a difference between the calculated maximum distances.

2. A classification method for classifying a golf swing conducted by a golfer when the golfer hits a golf ball by a golf club; the method comprising steps of:

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a first trajectory distribution;

determining straight lines connecting each of one point selected within each of the two golf swing trajectories and the origin so as to calculate angles between each of the determined straight lines and the horizontal line respectively for the two golf swing trajectories;

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a second trajectory distribution;

calculating maximum distances along a direction of the horizontal axis from the origin respectively for the two golf swing trajectories; and classifying the golf swing based on a difference between the calculated angles and a difference between the calculated maximum distances.

3. A classification system for classifying a golf swing conducted by a golfer when the golfer hits a golf ball by a golf club; the system comprising:

an imaging camera for imaging the golf swing by the golfer and an analysis device for analyzing the imaged golf swing; the analysis device including;

a measurement unit for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

a characteristics extraction unit for calculating maximum distances along a direction of the horizontal axis from the origin respectively for the two golf swing trajectories; and a statistical processing unit for classifying the golf swing based on a difference between the calculated maximum distances.

4. A classification system for classifying a golf swing conducted by a golfer when the golfer hits a golf ball by a golf club; the system comprising:

an imaging camera for imaging the golf swing by the golfer and a analysis device for analyzing the imaged golf swing; the analysis device including;

a measurement unit for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a first trajectory distribution and for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a second trajectory distribution;

a characteristics extraction unit for determining straight lines connecting each of one point selected within each of the two golf swing trajectories and the origin so a to calculate angles between each of the determined straight lines and the horizontal line respectively for the first trajectory distribution and for calculating maximum distances along a direction of the horizontal axis from the origin respectively for the second trajectory distribution;

a statistical processing unit for classifying the golf swing based on a difference between the calculated angles and a difference between the calculated maximum distances.

5. A classification device for classifying a golf swing conducted by a golfer when the golfer hits a golf ball by a golf club; the device comprising:

a measurement unit for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

a characteristics extraction unit for calculating maximum distances along a direction of the horizontal axis from the origin respectively for the two golf swing trajectories; and a statistical processing unit for classifying the golf swing based on a difference between the calculated maximum distances.

6. A classification device for classifying a golf swing conducted by a golfer when the golfer hits a golf ball by a golf club; the device comprising:

a measurement unit for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a first trajectory distribution and for partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a second trajectory distribution;

a characteristics extraction unit for determining straight lines connecting each of one point selected within each of the two golf swing trajectories and the origin so a to calculate angles between each of the determined straight lines and the horizontal line respectively for the first trajectory distribution and for calculating maximum distances along a direction of the horizontal axis from the origin respectively for the second trajectory distribution;

a statistical processing unit for classifying the golf swing based on a difference between the calculated angles and a difference between the calculated maximum distances.

7. A non-transitory computer-readable medium storing a program for executing the following steps by a computer functioning as an analysis device for analyzing a golf swing conducted by a golfer when the golfer hits a golf ball by a golf club; the program comprising the steps of:

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories;

calculating maximum distances along a direction of the horizontal axis from the origin respectively for the two golf swing trajectories; and classifying the golf swing based on a difference between the calculated maximum distances.

8. A non-transitory computer-readable medium storing a program for executing the following steps by a computer functioning as an analysis device for analyzing a golf swing conducted by a golfer when the golfer hits a golf ball by a golf club; the program comprising the steps of:

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a first trajectory distribution;

determining straight lines connecting each of one point selected within each of the two golf swing trajectories and the origin so as to calculate angles between each of the determined straight lines and the horizontal line respectively for the two golf swing trajectories;

partitioning the golf swing of the golfer into golf swing trajectories of a back swing, a down swing, and a follow through so as to determine a stable point in the golf swing trajectories as an origin for any two of the trajectories of the back swing, the down swing, and the follow through and to assign a two dimensional coordinate having a vertical axis and a horizontal axis to the two golf swing trajectories for producing a second trajectory distribution;

calculating maximum distances along a direction of the horizontal axis from the origin respectively for the two golf swing trajectories; and classifying the golf swing based on a difference between the calculated angles and a difference between the calculated maximum distances.

* * * * *